US007779807B2

(12) United States Patent
Tanaka et al.

(10) Patent No.: US 7,779,807 B2
(45) Date of Patent: Aug. 24, 2010

(54) INTAKE/EXHAUST VALVE AND ITS SEAL FOR INTERNAL COMBUSTION ENGINE

(75) Inventors: Hisato Tanaka, Wako (JP); Tsuneo Endoh, Wako (JP); Yasuhisa Tateoka, Wako (JP); Hiroaki Hara, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 92 days.

(21) Appl. No.: 10/983,662

(22) Filed: Nov. 9, 2004

(65) Prior Publication Data

US 2005/0098137 A1 May 12, 2005

(30) Foreign Application Priority Data

Nov. 11, 2003 (JP) ..... 2003-381724
Nov. 11, 2003 (JP) ..... 2003-381734

(51) Int. Cl.
*F01L 3/20* (2006.01)
*F01L 3/22* (2006.01)

(52) U.S. Cl. ..... 123/188.2; 123/188.8

(58) Field of Classification Search . 123/188.2–188.15, 123/188.4, 193.5, 432, 302, 188, 2, 15
See application file for complete search history.

(56) References Cited

U.S. PATENT DOCUMENTS

| | | | | |
|---|---|---|---|---|
| 1,444,857 | A | 2/1923 | Taub | |
| 3,820,522 | A * | 6/1974 | Scherenberg | 123/188.8 |
| 3,995,609 | A * | 12/1976 | Klomp | 123/188.8 |
| 4,217,875 | A * | 8/1980 | Elsbett et al. | 123/188.8 |
| 4,407,242 | A * | 10/1983 | Blum | 123/188.8 |
| 4,502,433 | A * | 3/1985 | Becker et al. | 123/188.8 |
| 4,545,706 | A | 10/1985 | Hiroyasu et al. | |
| 4,723,518 | A * | 2/1988 | Kawasaki et al. | 123/188.8 |
| 4,739,968 | A | 4/1988 | Schabinger | |
| 5,018,497 | A * | 5/1991 | Tsuchida | 123/432 |
| 5,127,380 | A * | 7/1992 | Morishita | 123/432 |
| 5,313,917 | A * | 5/1994 | Santi | 123/90.67 |
| 5,335,634 | A * | 8/1994 | Hashimoto et al. | 123/188.14 |
| 5,768,779 | A * | 6/1998 | Adachi | 29/888.06 |
| 6,125,807 | A * | 10/2000 | Nishi et al. | 123/90.27 |
| 6,199,544 | B1 * | 3/2001 | Feuling | 123/661 |
| 6,298,817 | B1 * | 10/2001 | Hoeg | 123/188.3 |
| 6,679,219 | B1 * | 1/2004 | Pacinelli | 123/188.3 |
| 2002/0020384 | A1 * | 2/2002 | Hoeg | 123/188.3 |

FOREIGN PATENT DOCUMENTS

DE 197 46 235 A1 5/1998

(Continued)

*Primary Examiner*—M. McMahon
(74) *Attorney, Agent, or Firm*—Birch, Stewart, Kolasch & Birch, LLP

(57) ABSTRACT

An intake/exhaust valve seal structure for an internal combustion engine is disclosed. A sealing surface is formed by a valve seat surface in a ceiling of a combustion chamber and a valve face surface provided on an intake/exhaust valve. The sealing surface lies on a first conical surface having an axis of the intake/exhaust valve as its rotation axis and includes a line of intersection of the first conical surface with an inner wall face of the ceiling of the combustion chamber. A method for manufacturing the intake/exhaust valve is also disclosed.

19 Claims, 8 Drawing Sheets

FOREIGN PATENT DOCUMENTS

| | | | |
|---|---|---|---|
| DE | 100 09 315 | A1 | 8/2001 |
| EP | 0 237 814 | A1 | 9/1987 |
| EP | 0 727 565 | A1 | 8/1996 |
| FR | 2 395 394 | A1 | 1/1979 |
| JP | 62-183007 | U | 11/1987 |
| JP | 5-18219 | A | 1/1993 |
| JP | 2000-117386 | A | 4/2000 |
| JP | 2003-314230 | A | 11/2003 |

* cited by examiner

INTAKE/EXHAUST VALVE AND ITS SEAL FOR INTERNAL COMBUSTION ENGINE

FIELD OF THE INVENTION

This invention relates to an intake/exhaust valve seal structure of an internal combustion engine for forming a non-circular sealing surface, a method for forming a sealing surface of an intake/exhaust valve, a manufacturing method of an intake/exhaust valve, and an intake/exhaust valve.

BACKGROUND OF THE INVENTION

Intake/exhaust valve seal structures of internal combustion engines of related art made up of circular, elliptical or oval valves and valve seats, and intake/exhaust valves for internal combustion engines of related art with circular or elliptical head parts, are known from for example JP-UM-A-62-183007. The content of JP-UM-A-62-183007 will be discussed with reference to FIG. 8 and FIG. 9.

A manufacturing method of an intake/exhaust valve for an internal combustion engine of related art in which an onion-shaped part of an intermediate blank is pressed with a punch to form a head part of a final product shape is known from for example JP-A-2000-117386. The content of JP-A-2000-117386 will be discussed below with reference to FIGS. 10A and 10B.

In FIG. 8, an elliptical or oval intake valve seat 102 and a circular exhaust valve seat 103 are provided in a cylinder head body 101.

In FIG. 9, an intake valve 105 is fitted seatably in the intake valve seat 102 and an exhaust valve 106 is fitted seatably in the exhaust valve seat 103.

In FIG. 8 and FIG. 9, for example the sealing surface created by the circular exhaust valve seat 103 and the circular exhaust valve 106 lies on a conical surface. When the sealing surface is made a conical surface like this, the female taper surface on the exhaust valve seat 103 side forming the sealing surface and the male taper surface on the exhaust valve 106 side forming the sealing surface can each be formed with high accuracy and their gastightness made high, and the female taper surface and the male taper surface can be machined relatively easily.

However, when the exhaust valve seat 103 is circular, the area of the ceiling of the combustion chamber occupied by the exhaust valve seat 103 cannot be made large enough, and intake/exhaust efficiency is impaired. When an oval shape is adopted, as in the case of the intake valve seat 102, although the area of the opening of the intake valve seat 102 can be made larger than when it is circular, the space between this valve seat and the adjacent valve seat is still not being utilized effectively. If this space can be utilized effectively, while improvement of the gastightness of the sealing surface of the intake valve seat 102 and the intake valve 105 and improvement of the machinability of the intake valve seat 102 and the intake valve 105 are achieved, the area of the opening increases, intake/exhaust efficiency rises, the amount of air taken in increases (the amount of mixture also increases), and the output of the internal combustion engine improves.

FIG. 10A and FIG. 10B illustrate a method for manufacturing an intake/exhaust valve of an internal combustion engine. In FIG. 10A, an intermediate blank 114 made up of an onion-shaped part 111 and a stem part 112 extending integrally from this onion-shaped part 111 are pressed with a punch 117 into a die 116.

FIG. 10B shows the onion-shaped part 111 (see FIG. 10A) having been molded into a head part 121 to complete a valve 122, which is a finished product.

When the elliptical intake valve 105 and the circular exhaust valve 106 shown in FIG. 8 and FIG. 9 are employed, when the intake valve seat 102 and the exhaust valve seat 103 are disposed in the inner wall of the combustion chamber, a large space remains between these adjacent valve seats in the inner wall. If this space can be used more effectively, the profiles of the intake valve seat 102 and the exhaust valve seat 103 can be made large, along with this the profiles of the intake valve 105 and the exhaust valve 106 can be made large, and the intake/exhaust resistance of when the intake valve 105 and the exhaust valve 106 open can be reduced. One way to take advantage of the space is for example to make the profiles of the valve seats and valves a complex shape other than circular, elliptical or oval.

In FIG. 10A and FIG. 10B, to mold the profile of the head part 121 of the valve 122 to a complex shape, it is necessary to form a complex female shape on the die 116. In particular, to raise seal quality, the valve face surface that forms the sealing surface together with the valve seat must be formed to a high accuracy, and to form a valve face surface on the die 116 to a complex shape and to a high accuracy is difficult. Also, the cost of manufacturing an intake/exhaust valve with a complex shape is desired to be low.

Accordingly, means have been awaited for achieving improved gastightness of the sealing surface created by the valve seat surface and the valve face surface and improved machinability of the valve seat surface and the valve face surface while raising the intake/exhaust efficiency of the internal combustion engine, manufacturing an intake/exhaust valve with a non-circular complex shape particularly other than elliptical or oval easily and with high accuracy, and reducing cost.

SUMMARY OF THE INVENTION

According to an aspect of the present invention, there is provided an intake/exhaust valve seal structure of an internal combustion engine in which a sealing surface is formed by an annular valve seat surface provided on a ceiling of a combustion chamber of an internal combustion engine and a valve face surface provided on an intake/exhaust valve and formed approximately in the shape of a flare so as to make surface contact with the valve seat surface, wherein the sealing surface lies on a conical surface having the axis of a stem part of the intake/exhaust valve as its rotation axis and includes a line of intersection of this conical surface with an inner wall face of the ceiling.

In this intake/exhaust valve seal structure, because the sealing surface formed by the valve seat surface and the valve face surface lie on a conical surface, the valve seat surface and the valve face surface can be formed to a high accuracy and easily, and the gastightness and moldability of the sealing surface can be improved.

Also, for example when the inner wall face of the combustion chamber is a complex shape such as a curved face, the sealing surface becomes a three-dimensional shape, and compared to when the sealing surface has the shape of a circular ring, in this invention it is possible to make the profile of the sealing surface large; that is, the opening area of when the intake/exhaust valve is open can be increased. As a result, intake/exhaust efficiency can be raised and it is possible to increase the output of the internal combustion engine.

Preferably, the line of intersection of the sealing surface does not lie on a single flat plane. In this case, because the line of intersection of the sealing surface does not lie on a single flat plane, the shape of the sealing surface can be made a complex shape other than circular, elliptical or oval, it becomes possible for a larger area of the inner wall face of the ceiling of the combustion chamber to be occupied by the openings of the intake and exhaust passages, intake/exhaust efficiency can be raised further, and the output of the internal combustion engine can be raised further.

According to another aspect of the present invention, there is provided an intake/exhaust valve sealing surface forming method for an internal combustion engine in which a sealing surface is formed by an annular valve seat surface provided on a ceiling of a combustion chamber of an internal combustion engine and a valve face surface provided on an intake/exhaust valve and formed approximately in the shape of a flare so as to make surface contact with the valve seat surface and the sealing surface is formed so as to include a line of intersection of a conical surface having the axis of a stem part of the intake/exhaust valve as its rotation axis and an inner wall face of the ceiling, which method comprises the steps of: forming the valve seat surface with a cutting tool having a conical cutting face matching the conical surface; and making the valve face surface from a conical blank having a conical blank surface substantially matching the conical surface.

In this intake/exhaust valve sealing surface forming method, because the valve seat surface is formed with a cutting tool having a conical cutting face matching the conical surface and the valve face surface is formed from a conical blank having a conical blank surface substantially matching the conical surface, the valve seat surface and the valve face surface can be formed easily, costs can be kept down and productivity can be raised.

According to a further aspect of the present invention, there is provided a manufacturing method of an intake/exhaust valve for an internal combustion engine having formed on a head part thereof a valve face surface for making surface contact with a valve seat surface provided on a ceiling of a combustion chamber of an internal combustion engine to form a sealing surface with a non-circular profile, the manufacturing method comprising the steps of: setting the shape of the sealing surface from a line of intersection of a first conical surface having the axis of a stem part of the intake/exhaust valve as its rotation axis and an inner wall face of the ceiling of the combustion chamber; converting a head part shape determined by the shapes of a front side part and a rear side part of the head part and the shape of the sealing surface into machining data for machining with a machine tool; making a conical blank having a second conical surface substantially matching the first conical surface; and with the machine tool, machining the front side part and the rear side part of the head part to predetermined shapes, avoiding a part of the second conical surface of the conical blank that is to become the valve face surface.

In this intake/exhaust valve manufacturing method, because a non-circular sealing surface is formed by machining a conical blank having a second conical surface, which is a simple shape, its machinability can be improved, an intake/exhaust valve having a highly accurate valve face surface can be made easily, and the cost of the intake/exhaust valve can be kept down.

According to a still further aspect of the present invention, there is provided an intake/exhaust valve for an internal combustion engine made up of a stem part and a head part provided at an end of this stem part and having formed on the head part a valve face surface for making surface contact with a valve seat surface provided on a ceiling of a combustion chamber of an internal combustion engine to form a non-circular sealing surface, wherein the valve face surface is formed on a first conical surface having the axis of the stem part as its rotation axis and includes the line of intersection of this first conical surface with an inner wall face of the ceiling of the combustion chamber, and is formed by being brought into relief by material being cut away from a conical blank having a second conical surface substantially matching the first conical surface.

With this intake/exhaust valve, because the valve face surface is formed on a conical surface having the axis of the stem part as its rotation axis and includes the line of intersection of this first conical surface with an inner wall face of the ceiling of the combustion chamber, and is formed by being brought into relief by material being cut away from a conical blank having a second conical surface substantially matching the first conical surface, it is possible to make a highly accurate and furthermore low-cost intake/exhaust valve.

BRIEF DESCRIPTION OF THE DRAWINGS

Certain preferred embodiments of the present invention will be described in detail below, by way of example only, with reference to the accompanying drawings, in which.

DETAILED DESCRIPTION OF THE PREFERRED EMBODIMENTS

Figure 1:
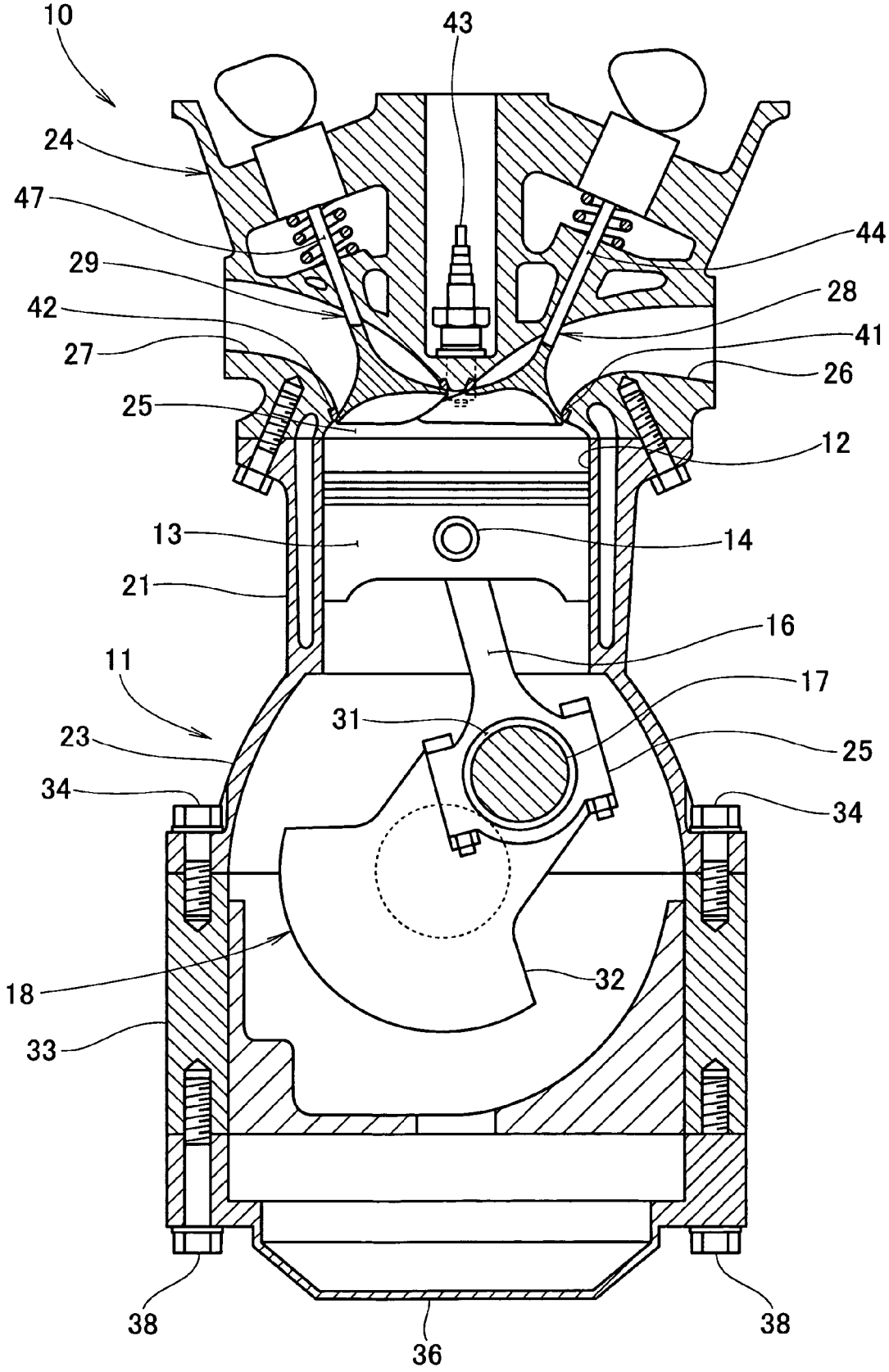
FIG. 1 is a sectional view of an internal combustion engine to which an intake/exhaust valve seal structure according to the invention has been applied.

Referring to FIG. 1, an internal combustion engine 10 has a cylinder block 11, a piston 13 movably fitted in a cylinder bore 12 provided in the cylinder block 11, a connecting rod 16 connected to this piston 13 by a piston pin 14, and a crankshaft 18 rotatably mounted at the bottom of the cylinder block 11 and swingably supporting the connecting rod 16 on a crank pin 17.

The cylinder block 11 is made up of a cylinder part 21 and an upper crank case 23 provided integrally with the bottom of this cylinder part 21, and has a cylinder head 24 attached to its top by way of a head gasket (not shown).

The cylinder head 24 has an intake port 26 and an exhaust port 27 connecting with a combustion chamber 25; the entrance of the intake port 26 is opened and closed by an intake valve 28, and the entrance of the exhaust port 27 is opened and closed by an exhaust valve 29.

Here, the reference number 31 denotes a sliding bearing interposed between a big end 30 of the connecting rod 16 and the crank pin 17; the reference number 32 a counterweight provided on the crankshaft 18; the reference number 33 a lower crank case attached to the bottom of the upper crank case 23 with bolts 34 to form a crank case together with the upper crank case 23; the reference number 36 an oil pan attached to the bottom of the lower crank case 33 with bolts 38; the reference number 41 an intake side valve seat that, when the intake valve 28 has closed, forms a sealing surface together with this intake valve 28; the reference number 42 an exhaust side valve seat that, when the exhaust valve 29 has closed, forms a sealing surface together with this exhaust valve 29; and the reference number 43 an ignition plug.

Figure 2:
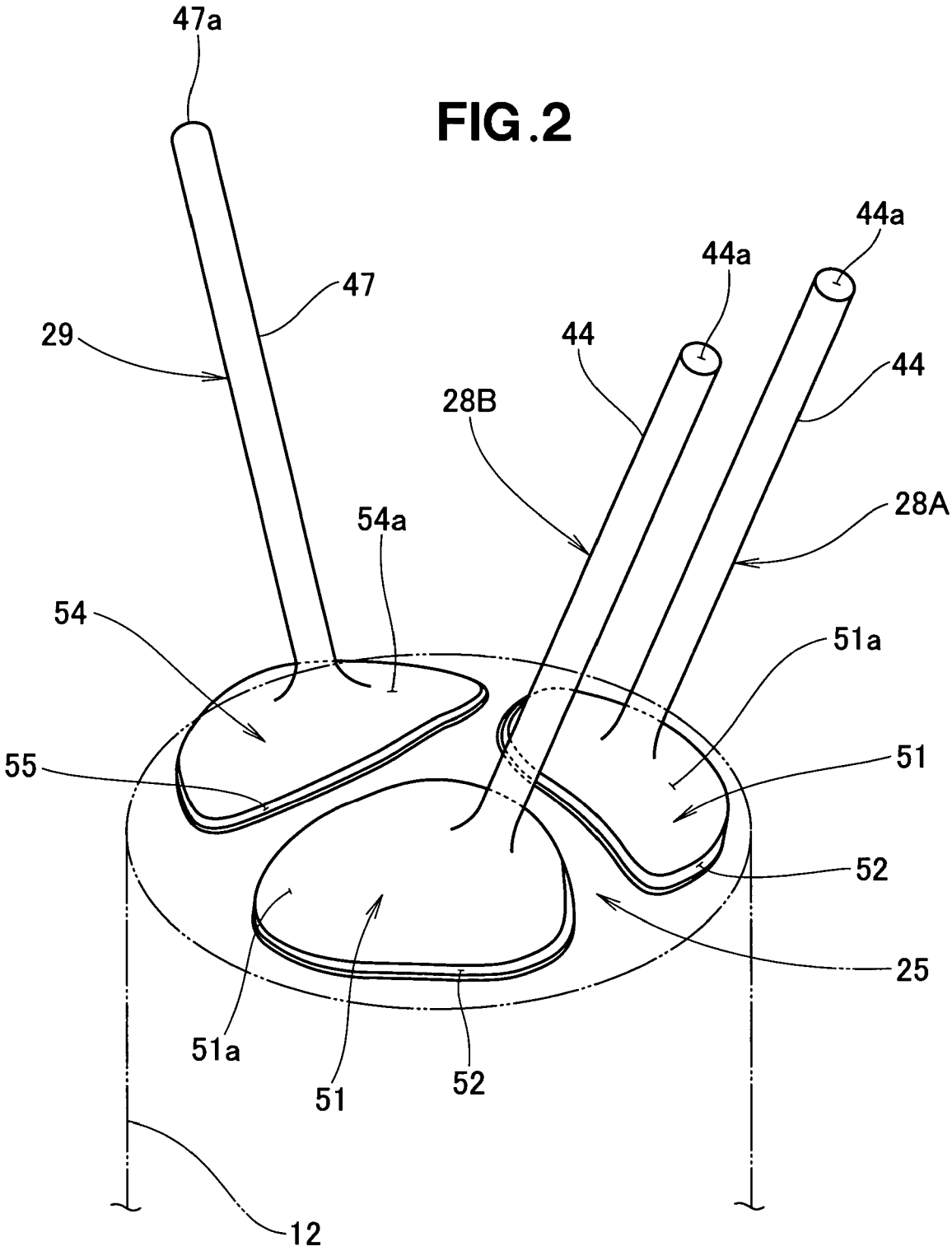
FIG. 2 is a perspective view of intake/exhaust valves according to the invention.

FIG. 2 shows intake valves 28 (here, two intake valves given the reference numerals 28A, 28B) and the exhaust valve 29 disposed in the ceiling of the combustion chamber 25.

The intake valves 28 are each made up of the above-mentioned stem part 44, which has the shape of a cylindrical rod, and a head part 51 provided integrally with an end of this stem part 44. By an end part 44*a* of the stem part 44 being pushed from a cam (not shown) side, the head part 51 is moved toward the piston 13 in the combustion chamber 25 (see FIG. 1) and opens the intake port 26 (see FIG. 1), and by the elastic force of a compressed valve spring (not shown) being made to act on the stem part 44, the head part 51 is moved toward the ceiling of the combustion chamber 25 and closes the intake port 26.

The stem part 44 has in the vicinity of its end part 44*a* a projecting part (not shown), and by this projecting part being guided in the axial direction by grooves provided in the cylinder head 24 (see FIG. 1) the intake valve 28 is prevented from turning about its axis.

The head part 51 is a part having formed on a seal side 51*a* (the side from which the stem part 44 extends) constituting a front side part an annular valve face surface 52 for forming a sealing surface.

The exhaust valve 29 is made up of the above-mentioned stem part 47, which has the shape of a cylindrical rod, and a head part 54 provided integrally with an end of this stem part 47. By an end part 47*a* of the stem part 47 being pushed from a cam (not shown) side, the head part 54 is moved toward the piston 13 in the combustion chamber 25 and opens the exhaust port 27 (see FIG. 1), and by the elastic force of a compressed valve spring (not shown) being made to act on the stem part 47, the head part 54 is moved toward the ceiling of the combustion chamber 25 and closes the exhaust port 27.

The stem part 47 has in the vicinity of its end part 47*a* a projecting part (not shown), and by this projecting part being guided in the axial direction by grooves provided in the cylinder head 24, the exhaust valve 29 is prevented from turning about its axis.

The head part 54 is a part having formed on a seal side 54*a* (the side from which the stem part 47 extends) an annular valve face surface 55 for forming a sealing surface.

Figure 3:
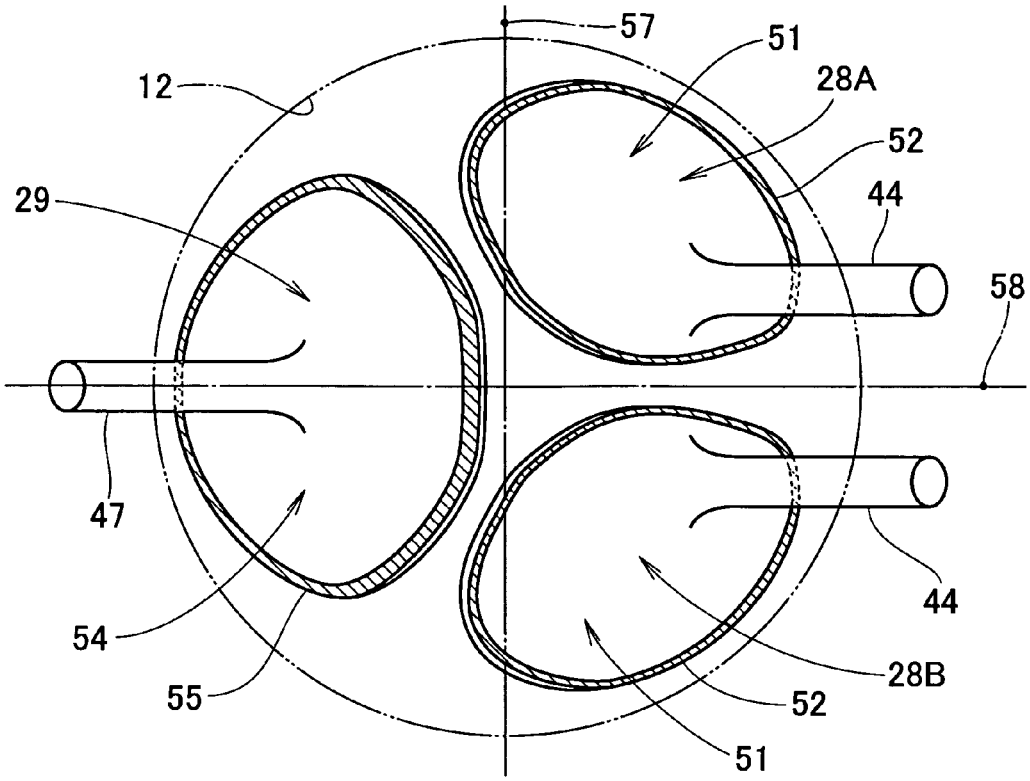
FIG. 3 is a plan view of intake/exhaust valves according to the invention.

Referring to FIG. 3, the intake valves 28*a*, 28*b* are members disposed symmetrically about a straight line 58 that is orthogonal to a straight line 57 drawn parallel with the direction in which the crankshaft 18 (see FIG. 1) extends and passes through the center of the cylinder bore 12. The two straight lines 57, 58 divide the cylinder head 24 into quadrants. Each of the intake valves 28*a*, 28*b* occupies approximately 80% or more of each of the two quadrants on one side of the straight line 57. The single exhaust valve 29 occupies approximately 60% of the two quadrants on the opposite side of the straight line 57, and is centered on the straight line 58. As a result of the three-dimensional shape of the intake and exhaust valves 28*a*, 28*b*, 29, the valves are capable of occupying a large portion of the cylinder head, thus allowing more efficient air flow into and out of the cylinder. As can be seen in FIG. 3, the head parts 51 of the intake valves 28*a*, 28*b* are each shaped substantially like a leaf of a tree, i.e. are non-circular, and the stem parts 44 are disposed parallel with the straight line 58 in plan view. The part of the head part 51 shown with hatching is the valve face surface 52.

The exhaust valve 29 is a member having its head part 54 formed in a non-circular shape symmetrical about the straight line 58 and having its stem part 47 lying on the straight line 58 in plan view. The part of the head part 54 shown with hatching is the valve face surface 55.

Figure 4:
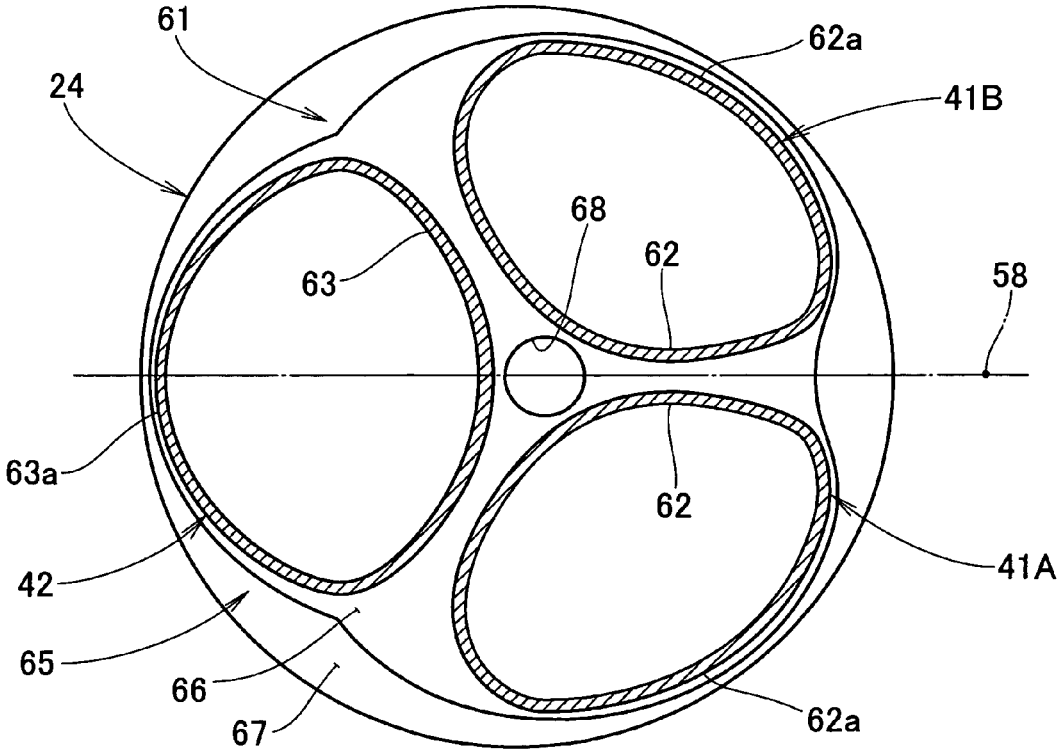
FIG. 4 is a bottom view showing the ceiling of a combustion chamber of a cylinder head according to the invention.

In FIG. 4, two intake valve seats 41 (here 41A and 41B) are fitted in the ceiling 61 of the combustion chamber 25 (see FIG. 1) in the cylinder head 24, symmetrically about the straight line 58, and an exhaust valve seat 42 shaped symmetrically about the straight line 58 is fitted in the ceiling 61 next to these intake valve seats 41A, 41B. The parts of the intake valve seats 41A, 41B shown with hatching are valve seat surfaces 62, and the part of the exhaust valve seat 42 shown with hatching is a valve seat surface 63.

The inner wall face 65 of the ceiling 61 is made up of a concave surface 66 made a concave curved surface including contours 62*a*, 63*a* of the valve seat surfaces 62, 63 and a substantially flat, annular squish surface 67 provided around this concave surface 66.

A plug fitting hole 68 for an ignition plug (not shown) to be fitted in is provided in the approximate center of the concave surface 66.

Figure 5:
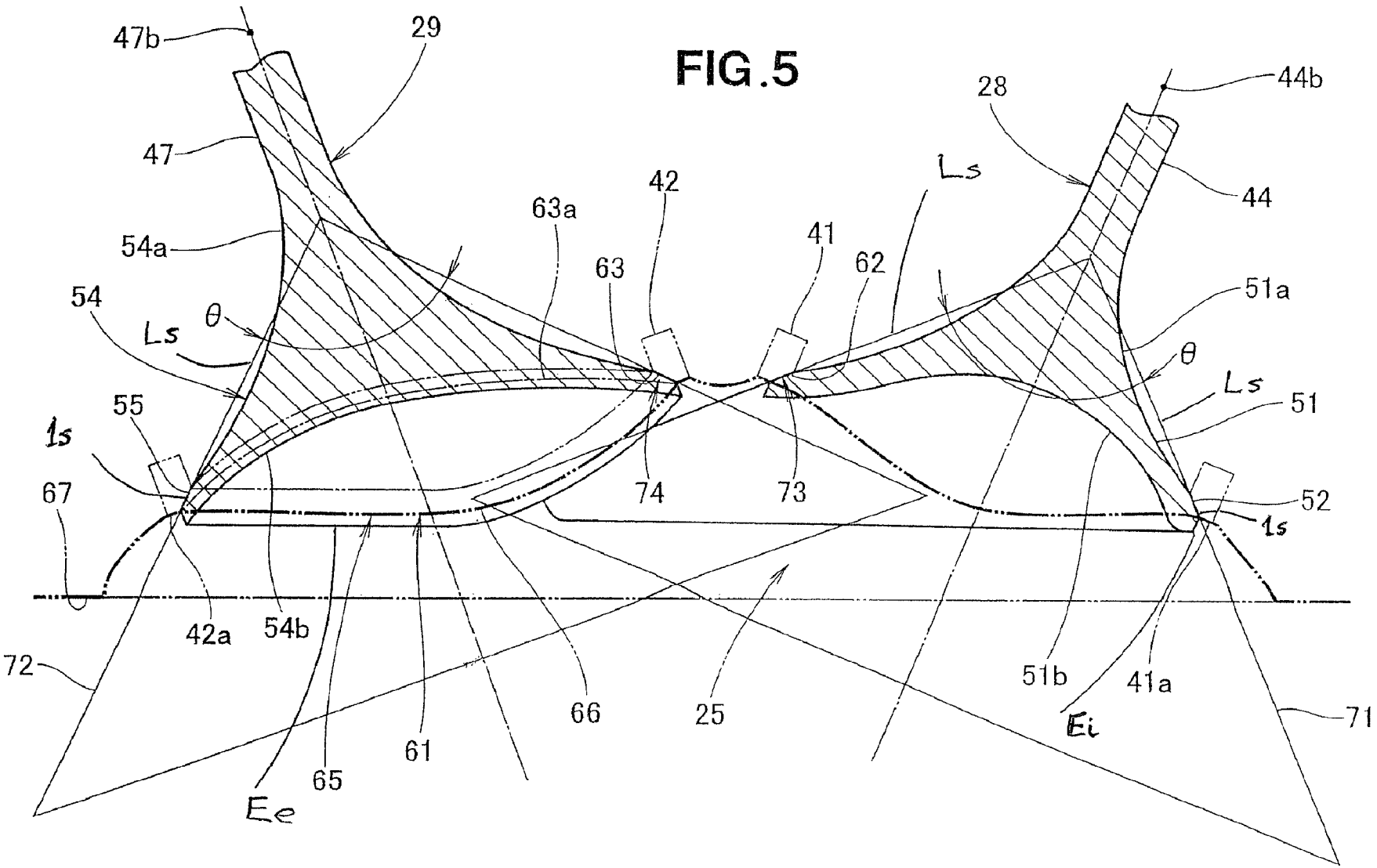
FIG. 5 is a view illustrating intake/exhaust valves, valve seats and sealing surfaces according to the invention.

The squish surface 67 is a part for forming a squish part together with the crown part of the piston 13 (see FIG. 1); by forming a squish part with a narrow gap at the end of the compression stroke of the piston 13 and pushing mixture inside this squish part out, it causes the mixture in the combustion chamber to flow and increases its combustion rate.

referring to FIG. 5, when conical surfaces 71, 72 having the axes 44*b*, 47*b* of the stem parts 44, 47 of the intake/exhaust valves 28, 29 as axes of rotation (the apex angles of the cross-sections passing through the axes 44*b*, 47*b* being θ (for example, θ=90°)), the lines of intersection of these conical surfaces 71, 72 with the inner wall face 65 formed in the predetermined shape of the combustion chamber (here, the cross-section of the inner wall face 65 is shown with a thick broken line) are the above-mentioned contours 62*a*, 63*a* of the valve seat surfaces 62, 63 (for 62*a* see FIG. 4), and the valve seat surfaces 62, 63 lie on the conical surfaces 71, 72. Each of the valves 28, 29 is configured such that when every cross-section of the valve 28, 29 which includes the corresponding axis 44*b*, 47*b* of the stem 44, 47 is viewed from a direction perpendicular to the cross-section, the cross-section is seen to cut through the sloped valve face surface 52, 55 on opposite sides of the valve 28, 29, defining a pair of straight slope lines ls on opposite sides of the valve 28, 29 (i.e., parts of the conical surfaces 71, 72 on opposite sides of the valve 28, 29.) Examples of cross-sectional views of the valves 28, 29, which include the corresponding axis 44*b*, 47*b* of the stem 44, 47, are shown in FIG. 5. If the straight slope lines ls on opposite sides of the valve 28, 29 were to extend from every position along the entire perimeter of the non-symmetrical, sloped valve face surface 52, 55 and in a direction that is toward the axis 44*b*, 47*b* of the corresponding stem part 44, 47, each one of the extended straight slope lines Ls would converge at a predetermined point located along a length of the stem part 44, 47. In addition, each of the extended slope lines Ls extends at an angle θ/2 with respect to an axis 44*b*, 47*b* of the corresponding stem part 44, 47. Further, the perimeter of each of the valve 28, 29 is formed such that fewer than each of the extended straight slope lines Ls has the same length between the non-symmetrical, sloped valve face surface 52, 53 and the predetermined point. Also, since the inner wall face 65, or specifically the concave surface 66, has a complex shape, each of the contours 62*a*, 63*a* is three-dimensional in shape and does not lie on a single flat plane. Still further, FIG. 5 illustrates that no part of the lower peripheral edge Ei, Ee of the intake/exhaust valves 28, 29 lies on a flat plane that is perpendicular to the axis 44*b*, 47*b* of the corresponding stem part 44, 47.

The valve face surfaces 52, 55 of the intake/exhaust valves 28, 29, like the valve seat surfaces 62, 63, lie on the conical surfaces 71, 72.

Respective end faces 41*a*, 42*a* of the intake valve seats 41 and the exhaust valve seat 42 facing into the combustion chamber 25 are faces connecting with the inner wall face 65, and specifically the concave surface 66.

Of the valve seat surfaces 62, 63 and the valve face surfaces 52, 55, one overlaps the other completely, or, preferably, they overlap each other completely, so as to form sealing surfaces 73, 74.

The manufacture of the intake/exhaust valves 28, 29 discussed above will now be described briefly.

First, as explained with reference to FIG. 5, the shapes of the sealing surfaces 73, 74 are set from the lines of intersection of the conical surfaces 71, 72 having the axes 44*b*, 47*b* of the stem parts 44, 47 of the intake/exhaust valves 28, 29 as axes of rotation and the inner wall face 65 of the combustion chamber 25, i.e. the contours 62*a*, 63*a* (see FIG. 4). Specifically, from the contours 62*a*, 63*a* the shapes of the valve seat surfaces 62, 63 are set and the shapes of the valve face surfaces 52, 55 of the intake/exhaust valves 28, 29 are set.

Figure 7A:
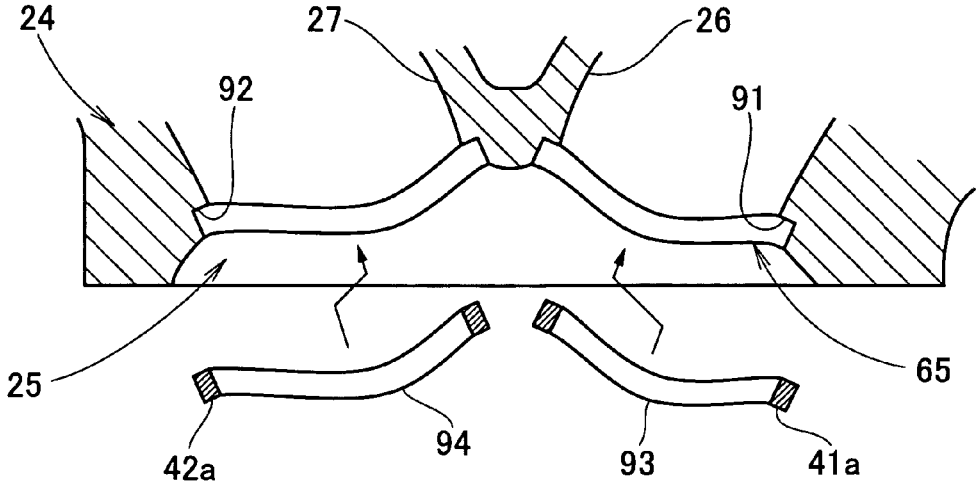
FIGS. 7A to 7C are process views illustrating the forming of valve seat surfaces according to the invention, FIG. 7A being a view showing valve seat blanks being press-fitted into an inner wall face of a combustion chamber, FIG. 7B a view showing the machining of a valve seat blank, and FIG. 7C a view showing valve seat surfaces having been formed.
Figure 7B:
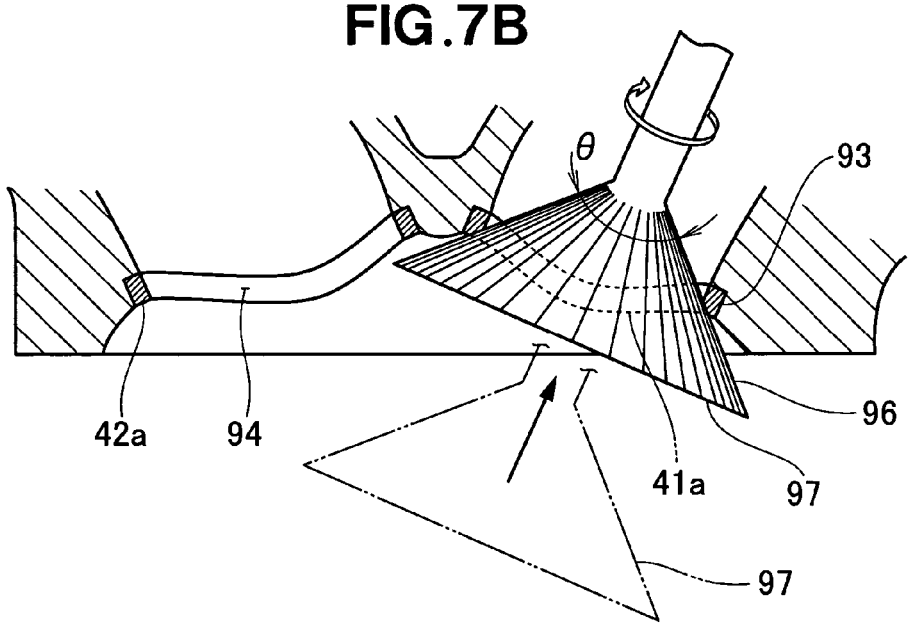
Figure 7C:
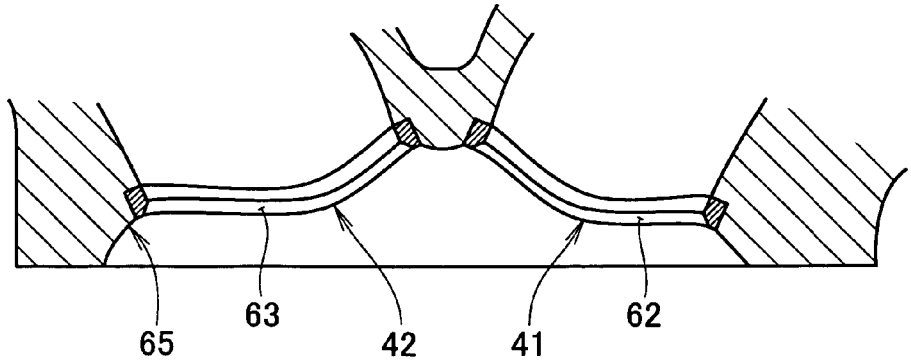
Figure 8:
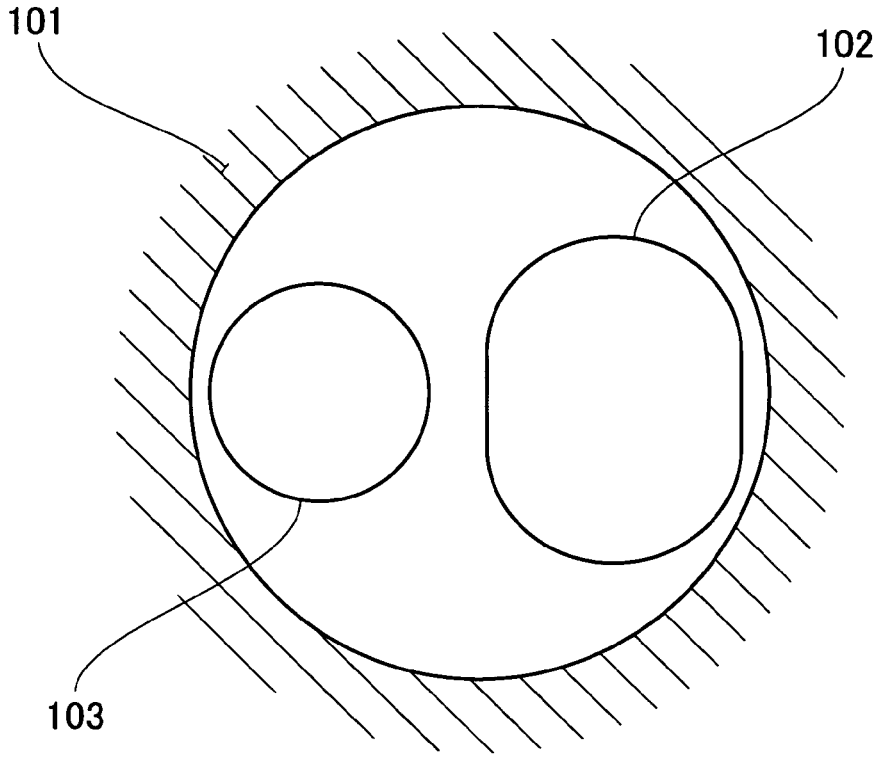
FIG.8 (PRIOR ART)
FIG. 8 is a bottom view showing the intake/exhaust valve seal structure of an internal combustion engine of related art.
Figure 9:
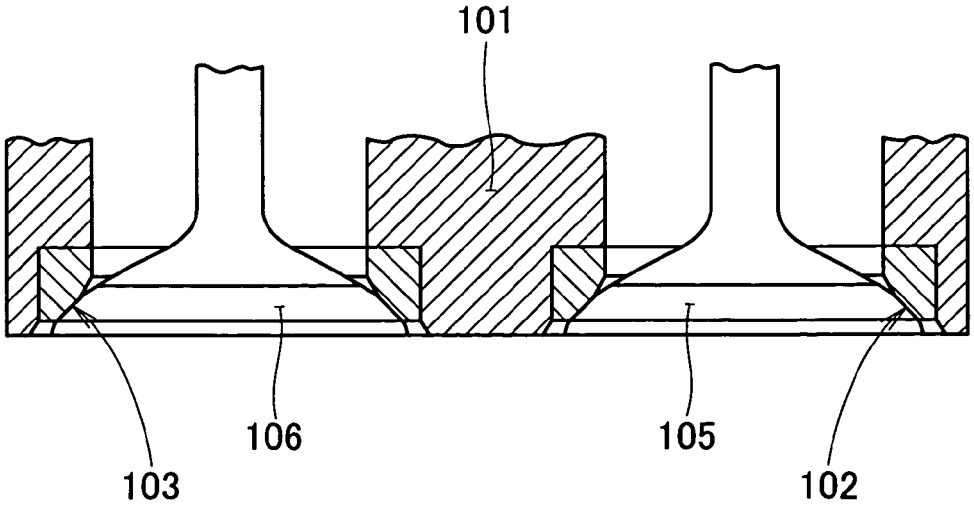
FIG.9 (PRIOR ART)
FIG. 9 is a longitudinal sectional view of the intake/exhaust valve seal structure of an internal combustion engine of related art.
Figure 10A:
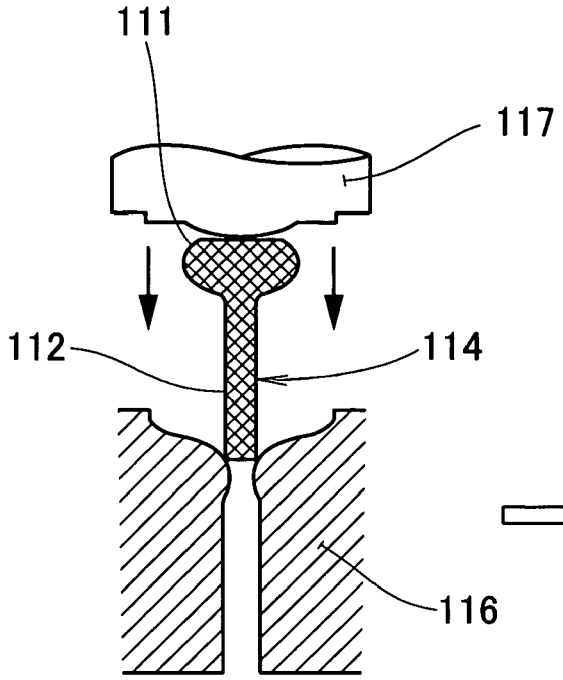
FIG.10A (PRIOR ART)
FIGS. 10A and 10B are process views illustrating a manufacturing method of a related art intake/exhaust valve for an internal combustion engine, FIG. 10A being a view showing an intermediate blank being pressed with a die punch and FIG. 10B a view illustrating the molding of a head part of a valve.
Figure 10B:
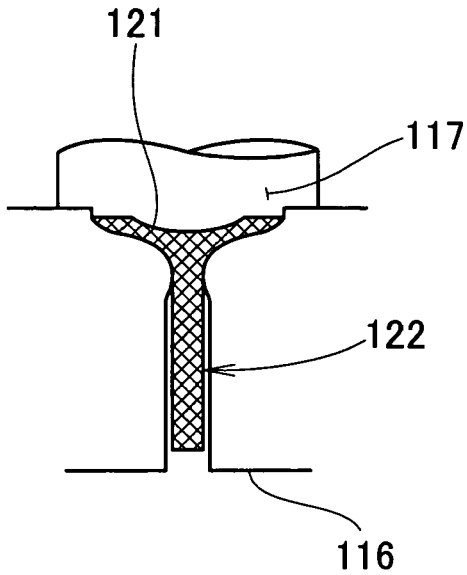
FIG.10B (PRIOR ART)

Then, as shown in FIG. 7A, FIG. 7B and FIG. 7C below, the valve seat surfaces 62, 63 are machined.

Next, the shapes of the head parts 51, 54, which are determined by the shapes of the seal sides 51*a*, 54*a* and the combustion chamber sides 51*b*, 54*b* of the head parts 51, 54 and the shapes of the sealing surfaces 73, 74, are converted into machining data for machining with a machine tool.

Figure 6A:
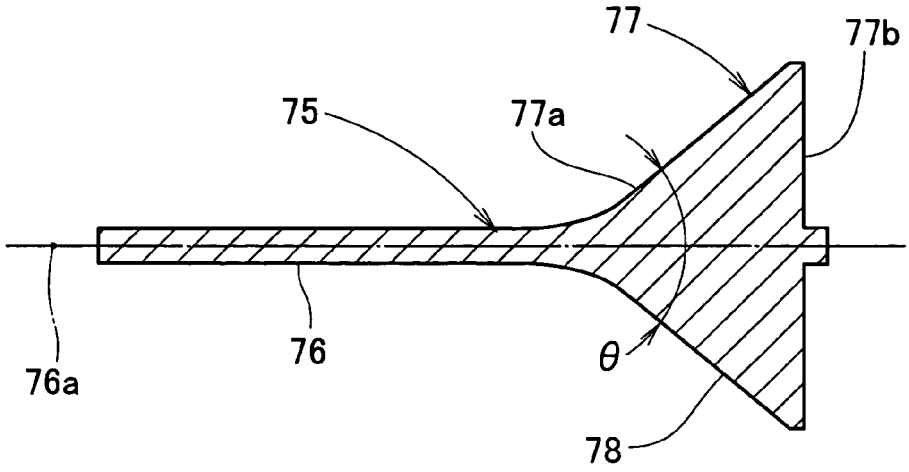
FIGS. 6A to 6C are process views illustrating the manufacture of an intake/exhaust valve according to the invention, FIG. 6A being a sectional view of a blank for manufacturing an intake/exhaust valve, FIG. 6B a view illustrating the machining of a head part, and FIG. 6C a view showing the blank having been ground to form a valve face surface.
Figure 6B:
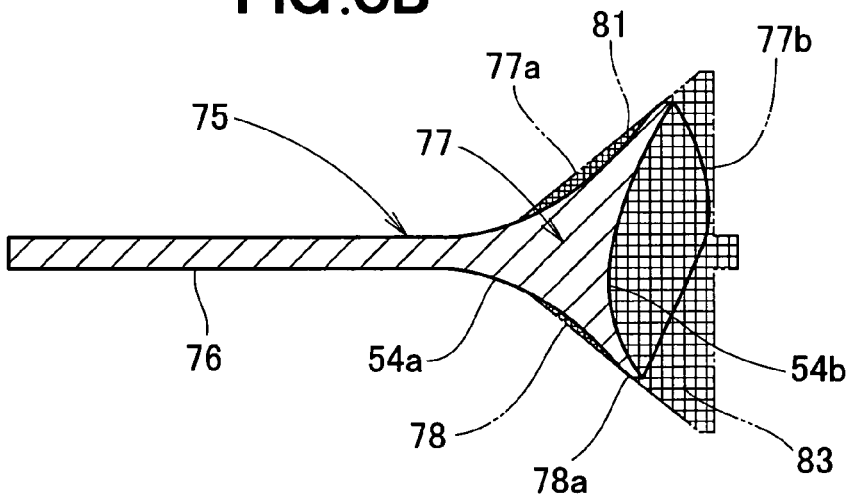
Figure 6C:
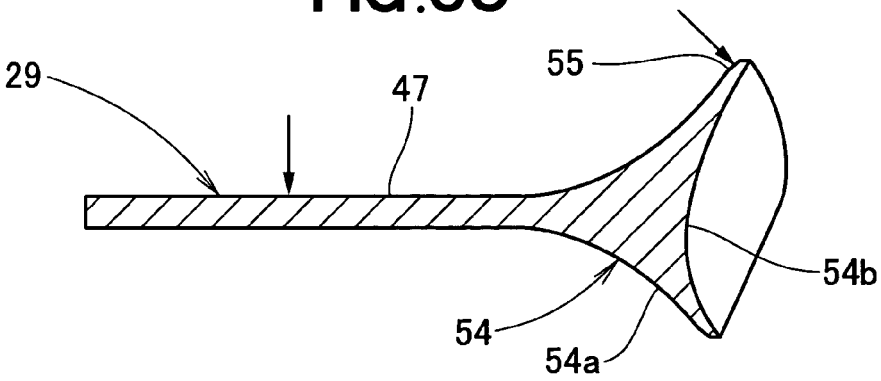

Then, as shown in FIG. 6A, FIG. 6B and FIG. 6C, a blank for manufacturing an intake or exhaust valve 28, 29 is made, and this blank is machined.

FIG. 6A is a sectional view showing a blank 75 for manufacturing an intake or exhaust valve 29 (see FIG. 5).

The blank 75 is made up of a stem part 76 and a head part 77 formed integrally with the end of this stem part 76, and a seal side 77*a* of the head part 77 has a conical blank surface 78 with the axis 76*a* of the stem part 76 as an axis of rotation and with an apex angle of θ.

In FIG. 6B, on the seal side 77*a* of the head part 77, machining is carried out to leave a male taper shaped blank seal surface 78*a* of the conical blank surface 78 to form a sealing surface (that is, a face be made a valve face surface). The reference number 81 denotes an annular cut portion (the portion shown with a fine grid pattern) removed by this machining.

A combustion chamber side 77*b* constituting the opposite side from the seal side 77*a* of the head part 77 is also machined to form for example the combustion chamber side 54*b* constituting the opposite side from the seal side 54*a* of an exhaust valve 29 (see FIG. 6C) (in the case of an intake valve, this is the combustion chamber side 51*b* (see FIG. 5)). The reference number 83 denotes a bottom cut portion (the portion shown with a coarse grid pattern) that is the part of the combustion chamber side 77*b* cut away in this step.

In FIG. 6C, the male taper shaped blank seal surface 78*a* (see FIG. 6B) to form a sealing surface is ground to form a valve face surface 55 (the part shown with an arrow; in the case of an intake valve the valve seat surface 52 (see FIG. 5)).

The stem part 76 (see FIG. 6B) is ground to form a stem part 47 (the part shown with an arrow; in the case of an intake valve, the stem part 44 (see FIG. 5)). This completes the manufacture of an exhaust valve 29 (or similarly an intake valve 28 (see FIG. 5)).

As shown in the above FIG. 6A, FIG. 6B and FIG. 6C, in a method for manufacturing an intake/exhaust valve 28, 29 of this invention, in forming the part 51, 54, by a blank seal surface 78*a* being formed, that is, brought into relief, by parts of a conical blank surface 78 of the blank 75 other than a blank seal surface 78*a* being machined, it is possible to form the valve face surface 52, 55 highly accurately and also simply just by grinding the blank seal surface 78*a*.

In FIG. 7A, annular valve seat blanks 93, 94 are press-fitted as shown with arrows into valve seat mounting steps 91, 92 formed in advance in the inner wall face 65 of the combustion chamber 25.

In FIG. 7B, a cutter 97 having a conical cutting face 96 with an apex angle θ is brought into contact with the valve seat blank 93 from the end face 41*a* thereof and rotated to cut the valve seat blank 93 and form a valve seat surface. The same machining is carried out on the valve seat blank 94.

FIG. 7C shows an intake valve seat 41 having a valve seat surface 62 formed on it and an exhaust valve seat 42 having a valve seat surface 63 formed on it.

Although in this preferred embodiment of the invention valve seats were provided on the inner wall face of the combustion chamber, the invention is not limited to this, and alternatively the valve seat surfaces may be provided directly on the inner wall face of the cylinder head without valve seats being provided. Or, a metal different from that of the cylinder head base metal may be welded to the inner wall face of the combustion chamber, and the valve seat surface provided on the face of this welded part as a new inner wall face.

The line of intersection of the conical surface and the inner wall face of the ceiling does not have to be the contour of the valve seat surface, and may be a contour to the inner side or any line on the valve seat surface.

Also, although the conical blank was made a one-piece molding, there is no limitation to this, and the conical blank may alternatively be made from a stem part and a head part separate from this stem part by the stem part and the head part being joined integrally together.

Obviously, various minor changes and modifications of the present invention are possible in the light of the above teaching. It is therefore to be understood that within the scope of the appended claims the invention may be practiced otherwise than as specifically described.

What is claimed is:

1. An intake/exhaust valve seal structure for an internal combustion engine, comprising:

an exhaust valve and at least one intake valve associated with a combustion chamber, each of which has a stem part and a non-symmetrical, sloped valve face surface;

a sealing surface formed by a non-symmetrical, sloped valve seat surface provided on a ceiling of the combustion chamber for each of the exhaust and intake valves, the sealing surface formed as a sloped surface that tapers inwardly in a direction toward intake/exhaust ports of the engine; and the non-symmetrical, sloped valve face surface provided on each of the exhaust and intake valves making surface contact with the corresponding non-symmetrical, sloped valve seat surface of the combustion chamber, wherein the stem part of each of the exhaust and intake valves includes an axis, wherein each of the valves is configured such that when every cross-section of the valve which includes the axis of the stem is viewed from a direction perpendicular to the cross-section, the cross-section is seen to cut through the sloped valve face surface on opposite sides of the valve, defining a pair of straight slope lines (ls) on opposite sides of the valve, and if the straight slope lines (ls) were to extend in a direction from every position along the entire perimeter of the non-symmetrical, sloped valve face surface and in a direction that is toward the axis of the corresponding stem part, each one of the extended straight slope lines (Ls) would converge at a predetermined point located along a length of the stem part, wherein each of the extended straight slope lines (Ls) extends at an angle θ/2 with respect to the axis of the corresponding stem part, and wherein the non-symmetrical, sloped valve face surface of each of the valves is formed such that fewer than each of the extended straight slope lines (Ls) has the same length between the non-symmetrical, sloped valve face surface and the predetermined point.

2. The intake/exhaust valve seal structure of an internal combustion engine according to claim 1, wherein an edge of each of the non-symmetrical, sloped valve seat surfaces of the combustion chamber joins an inner wall face of the ceiling of the combustion chamber, and the inner wall face does not lie on a single flat plane.

3. The intake/exhaust valve seal structure of an internal combustion engine according to claim 1, wherein each of the non-symmetrical, sloped valve seat surfaces of the combustion chamber has a shape of an irregular curve.

4. The intake/exhaust valve seal structure of an internal combustion engine according to claim 1, wherein the ceiling of the combustion chamber has an inner wall face, the inner wall face of the ceiling including:

a single concave surface surrounding contours of each of the non-symmetrical, sloped valve seat surfaces; and a single substantially flat annular surface provided around the single concave surface.

5. The intake/exhaust valve seal structure of an internal combustion engine according to claim 4, the combustion chamber further comprising a plug fitting hole in an approximate center of the concave surface.

6. The intake/exhaust valve seal structure of an internal combustion engine according to claim 1, wherein, for each of the intake/exhaust valves, each of the extended straight slope lines (Ls), disposed respectively on the opposite sides of the valve, converges at the predetermined point located along the length of the stem part at a same angle, even if the two extended straight slope lines (Ls) have lengths that are not equal.

7. The intake/exhaust valve seal structure of an internal combustion engine according to claim 1, wherein the intake valve includes two intake valves and an exhaust valve, wherein the intake valves are disposed symmetrically about a first straight line that extends through the stem part of the exhaust valve and is orthogonal to a second straight line drawn parallel with a direction in which a crankshaft extends, and wherein the stem parts of the intake valves and the exhaust valve are parallel with the first straight line in plan view.

8. The intake/exhaust valve seal structure of an internal combustion engine according to claim 1, wherein the intake valve includes two intake valves and the exhaust valve, wherein with the axes of the stem parts of the intake valves are parallel to each other, and the axes of the stem parts of the intake valves are not parallel to the axis of the exhaust valve.

9. The intake/exhaust valve seal structure of an internal combustion engine according to claim 1, wherein the intake valves are disposed symmetrically about a first straight line that is orthogonal to a second straight line drawn parallel with a direction in which a crankshaft extends and passes through a center of a cylinder bore, wherein the first and second straight lines divide the cylinder head into quadrants, wherein each of the intake valves occupies approximately 80% or more of each of the two quadrants on one side of the second straight line, while the exhaust valve occupies approximately 60% of the two quadrants on the opposite side of the second straight line, the exhaust valve being centered on the first straight line, and since the intake and exhaust valves of occupying a relatively large portion of the cylinder head, air flowing into and out of the combustion chamber is efficient.

10. The intake/exhaust valve seal structure of an internal combustion engine according to claim 1, wherein each of the intake/exhaust valves includes a lower peripheral edge, no part of which is arranged on a plane that is perpendicular to the axis of the corresponding stem part.

11. An intake/exhaust valve for an internal combustion engine, comprising:

a stem part; and a non-symmetrical head part provided at an end of the stem part;

a non-symmetrical, sloped valve face surface formed on the head part for making surface contact with a matching non-symmetrical, sloped valve seat surface provided on a ceiling of a combustion chamber of an internal combustion engine to form a non-symmetrical sealing surface, wherein the stem part of each of the exhaust and intake valves includes an axis, wherein each of the valves is configured such that when every cross-section of the valve which includes the axis of the stem is viewed from a direction perpendicular to the cross-section, the cross-section is seen to cut through the sloped valve face surface on opposite sides of the valve, defining a pair of straight slope lines (ls) on opposite sides of the valve, and if the straight slope lines (ls) were to extend from every position along the entire perimeter of the non-symmetrical, sloped valve face surface and in a direction that is toward the axis of the corresponding stem part, each one of the extended straight slope lines (Ls) would converge at a predetermined point located along a length of the stem part, and such that fewer than each of the extended straight slope lines (Ls) has the same length between the non-symmetrical, sloped valve face surface and the predetermined point.

12. The intake/exhaust valve of an internal combustion engine according to claim 11, wherein the matching sloped valve seat surface of the combustion chamber has a shape of an irregular curve.

13. The intake/exhaust valve of an internal combustion engine according to claim 11, wherein the ceiling of the combustion chamber has an inner wall face, the inner wall face of the ceiling including:

a single concave surface surrounding contours of the matching sloped valve seat surfaces; and a single substantially flat annular surface provided around the single concave surface.

14. The intake/exhaust valve of an internal combustion engine according to claim 13, the combustion chamber further comprising a plug fitting hole in an approximate center of the concave surface.

15. The intake/exhaust valve of an internal combustion engine according to claim 11, wherein, for each of the exhaust and intake valves, each of the two extended straight slope lines (Ls), disposed respectively on opposite sides of the valve, converges at the predetermined point located along the length of the stem part at a same angle, even if the two extended straight slope lines (Ls) have lengths that are not equal.

16. The intake/exhaust valve of an internal combustion engine according to claim 11, wherein the intake/exhaust valve includes two intake valves and one exhaust valve, wherein the intake valves are disposed symmetrically about a first straight line that extends through the stem part of the exhaust valve and is orthogonal to a second straight line drawn parallel with a direction in which a crankshaft extends, and wherein the stem parts of the intake valves and the exhaust valve are parallel with the first straight line in plan view.

17. The intake/exhaust valve of an internal combustion engine according to claim 11, wherein the intake/exhaust valve includes two intake valves and an exhaust valve, wherein with the axes of the stem parts of the intake valves are parallel to each other, and the axes of the stem parts of the intake valves are not parallel to the axis of the exhaust valve.

18. The intake/exhaust valve of an internal combustion engine according to claim 11, wherein the intake valves are disposed symmetrically about a first straight line that is orthogonal to a second straight line drawn parallel with a direction in which a crankshaft extends and passes through a center of a cylinder bore, wherein the first and second straight lines divide the cylinder head into quadrants, wherein each of the intake valves occupies approximately 80% or more of each of the two quadrants on one side of the second straight line, while the exhaust valve occupies approximately 60% of the two quadrants on the opposite side of the second straight line, the exhaust valve being centered on the first straight line, and since the intake and exhaust valves of occupying a relatively large portion of the cylinder head, air flowing into and out of the combustion chamber is efficient.

19. The intake/exhaust valve of an internal combustion engine according to claim 11, wherein each of the intake/exhaust valves includes a lower peripheral edge, no part of which is arranged on a plane that is perpendicular to the axis of the corresponding stem part.

* * * * *